US006260223B1

(12) United States Patent
Mossbeck et al.

(10) Patent No.: US 6,260,223 B1
(45) Date of Patent: Jul. 17, 2001

(54) POCKETED COIL SPRING UNITS

(75) Inventors: Niels S. Mossbeck; Thomas J. Wells, both of Carthage, MO (US)

(73) Assignee: Leggett & Platt, Incorporated, Carthage, MO (US)

( * ) Notice: Subject to any disclaimer, the term of this patent is extended or adjusted under 35 U.S.C. 154(b) by 0 days.

(21) Appl. No.: 09/465,204

(22) Filed: Dec. 15, 1999

(51) Int. Cl.[7] ..... B68G 7/00; A47C 27/04

(52) U.S. Cl. ..... 5/720; 5/268; 267/91; 29/91.1

(58) Field of Search ..... 5/268, 716, 719, 5/720, 655.8; 29/91.1; 267/80, 90, 91

(56) References Cited

U.S. PATENT DOCUMENTS

| | | | |
|---|---|---|---|
| Re. 18,976 | | 10/1933 | Jones . |
| 216,142 | | 6/1879 | Bronson . |
| 239,575 | | 3/1881 | Townes . |
| 685,160 | | 10/1901 | Marshall . |
| 1,284,384 | | 11/1918 | Lewis . |
| 1,455,847 | | 5/1923 | Meutsch . |
| 1,466,617 | | 8/1923 | Foster . |
| 1,868,279 | | 7/1932 | Ehlenbeck . |
| 2,350,723 | * | 6/1944 | Buttner ..... 5/268 |
| 2,634,800 | | 4/1953 | Clark . |
| 2,805,429 | | 9/1957 | Woller . |
| 3,230,558 | | 1/1966 | Duncan . |
| 4,358,097 | | 11/1982 | Zapletal et al. . |
| 4,523,344 | | 6/1985 | Stumpf et al. . |
| 4,619,445 | | 10/1986 | Sasaki . |
| 4,766,624 | | 8/1988 | Yates et al. . |
| 4,886,249 | | 12/1989 | Docker et al. . |
| 4,905,333 | | 3/1990 | Scott . |
| 4,907,309 | | 3/1990 | Breckle . |
| 4,960,267 | | 10/1990 | Scott . |
| 5,127,635 | | 7/1992 | Long et al. . |
| 5,438,718 | | 8/1995 | Kelly et al. . |
| 5,669,093 | | 9/1997 | Ogle et al. . |
| 5,761,784 | | 6/1998 | Ogle et al. . |

FOREIGN PATENT DOCUMENTS

| | | |
|---|---|---|
| 703642 | 9/1967 | (BE) . |
| 348298 | 5/1931 | (GB) . |
| 491523 | 9/1938 | (GB) . |
| 2143731 | 2/1985 | (GB) . |

* cited by examiner

*Primary Examiner*—Michael F. Trettel
(74) *Attorney, Agent, or Firm*—Wood, Herron & Evans, L.L.P.

(57) ABSTRACT

Spring sets each include a pair of coil springs joined together by a connecting wire and are encased in individual fabric pockets such that the connecting wire joining the coil springs spans an otherwise empty fabric pocket. A spring unit, mattress or the like includes a number of such pocketed spring sets with the connecting wire being alternately positioned near a top face or a bottom face of the spring unit. The pocketed coil spring unit can be used to form a mattress or other spring assembly of pocketed coil springs wherein every third pocket is left empty. The connecting wire spreads the load across the empty pocket and distributes the load to the adjacent springs. The absence of one-third of the springs that are normally in a mattress drastically reduces material costs without diminishing performance.

33 Claims, 4 Drawing Sheets

POCKETED COIL SPRING UNITS

BACKGROUND OF THE INVENTION

This invention relates generally to spring units for use in mattresses, spring upholstered furniture and the like and, more particularly, to an improved pocketed coil spring unit and associated method of manufacturing such a spring unit.

A well known type of spring assembly includes a number of discrete coil springs, each of which is enclosed in a fabric pocket in a length of folded fabric material. Longitudinal axes of the spring coils are generally parallel with one another so that the top and bottom end turns of the coil springs define top and bottom faces of the spring unit. A spring assembly can be fabricated from such a spring unit by forming rows of the pocketed coil springs and binding or adhering the individual rows together to form a mattress or spring assembly.

This type of spring assembly is commonly referred to as a pocketed spring unit due to the fact that each spring is contained within an individual pocket of fabric material. The construction of strings of pocketed coil springs in each pocket is well known in the art and, for example, disclosed in U.S. Pat. No. 4,439,977 which is hereby incorporated by reference in its entirety. The system disclosed in that patent includes a spring coiler which forms a coil spring which is subsequently compressed and inserted between the plies of folded pocketing fabric material. Other systems for manufacturing pocketed coil spring assemblies are disclosed in PCT Patent Application No. WO94/18116 and U.S. patent application Ser. No. 08/927,051 filed Sep. 10, 1997, each of which are expressly incorporated herein by reference.

Pocketed spring units are generally recognized to have a unique and particular luxurious feel to them and mattresses manufactured of such pocketed spring units provide a feeling of softness without lacking spring resilience or support. Mattresses and similar articles constructed of pocketed spring units are often considered a high-end type of product because of the added benefits and features of the pocketed coil springs. Mattresses and the like of this type can be more costly to manufacture and assemble as a result of the considerable amount of time and labor which is involved in their manufacture, together with the fact that the method of fabrication and assembly of such pocketed spring units can be complicated, particularly in an automated process.

While known systems provide an automated method for producing and assembling pocketed spring units, the increased cost of materials and associated components for mattresses and other items incorporating such spring units can be a detriment to the commercial success of these products, even though they do provide enhanced softness and support as previously described.

Therefore, there is a need for an improved pocketed spring unit and associated method of manufacture which offers all the advantages of known pocketed spring units without the associated higher manufacturing costs and related disadvantages of known pocketed spring units.

SUMMARY OF THE INVENTION

These and other objectives of the invention have been obtained by an improved pocketed coil spring unit and associated method of manufacture for mattresses, spring upholstered furniture and the like according to this invention.

In one embodiment of this invention, a number of spring sets, each of which includes a first coil spring and a second coil spring which are joined together by a connecting wire at corresponding end turns of the first and second coil springs, are utilized. Each spring set is formed from an integral piece of spring wire. The spring sets are each encased in fabric pockets such that a grouping of adjacent fabric pockets includes first, second and third pockets which are serially connected with the third fabric pocket being between the first and second fabric pockets. The first coil spring of each spring set is inserted into the first fabric pocket and, likewise, the second coil spring of each spring set is inserted into the second fabric pocket. The connecting wire joining the coil springs spans the third fabric pocket which, in one embodiment of this invention, is empty with the exception of the connecting wire. The spring unit includes a number of such pocketed spring sets with the connecting wire being alternately positioned near a top or a bottom of the spring unit.

The pocketed coil spring unit of this invention can be used to form a mattress or other spring assembly of pocketed springs wherein every third pocket is left empty without a spring therein. As such, one goal of the invention is achieved by reducing the total amount of wire needed to form a pocketed spring coil mattress. The absence of one-third of the springs that are normally in a mattress drastically reduces manufacturing costs. Moreover, the ability to skip every third pocket does not diminish performance of a pocketed coil mattress because of the connecting wire joining the spring coils of each spring set. The connecting wire bridges over or spans the empty pocket so that when someone sits or lays on the mattress, the connecting wire spreads the load across the empty pocket and distributes the load to the adjacent springs. Advantageously, the connecting wire is located on the top and bottom surfaces of the spring unit so that the mattress or the like may be conveniently flipped top to bottom without altering its performance characteristics.

Another aspect of this invention is a method for manufacturing the pocketed coil spring unit such that each spring set is manufactured from a wire coiler which initially forms the first coil spring from one end turn to an opposite end turn of that coil spring. A connecting wire is then formed to project from the end turn of the first spring coil. Subsequently, the opposite end turn and the remainder of the second spring coil is formed. As such, a connecting wire joins opposite end turns of the first and second coil springs. The coil springs are then pivoted or manipulated relative to one another so that one coil spring is inverted, pivoted or manipulated relative to the other so that the connecting wire joins corresponding end turns of the two joined coil springs at either the top or bottom of the spring set depending upon its orientation. The spring set with the connecting wire joining corresponding end turns of the two coil springs is then inserted into the fabric pockets as previously described with the connecting wire spanning an empty pocket positioned between the two pocketed and joined coil springs. The pocketed spring sets are then arranged and assembled into the desired spring unit, mattress or the like.

As such, with this aspect of the invention, standard spring coiling machines can be used to produce the spring sets for use in spring units, mattresses or the like thereby avoiding the need for additional capital costs, machinery and complicated manufacturing processes and techniques.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
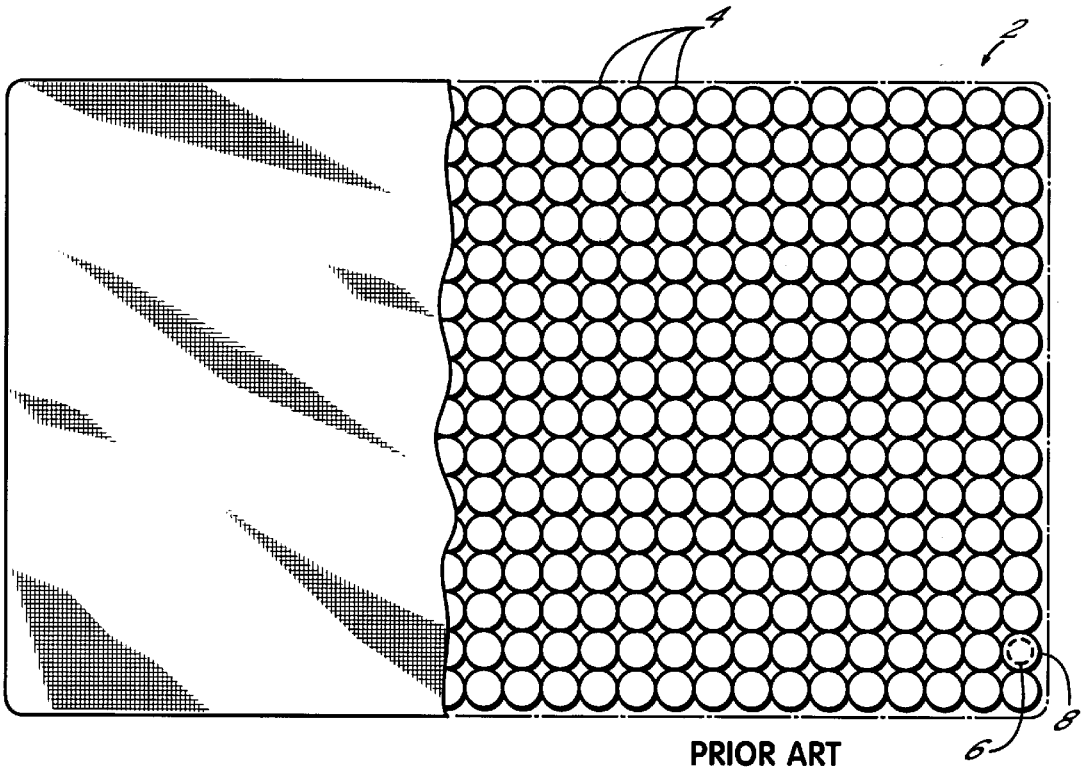
PRIOR ART FIG.1
FIG. 1 is a top plan view partially broken away of a prior art pocketed coil spring mattress.

Referring to FIG. 1, a prior art mattress 2 is shown which includes a number of rows 4 of pocketed coil springs 6. Each pocket 8 in the rows 4 of pocketed coil springs 6 encases a coil spring. Typically, in prior art pocketed coil spring mattresses 2, each pocketed coil spring 6 in each row 4 is aligned with an adjacent pocketed coil spring 6*a* of an adjacent row 4*a* to form a generally rectangular pattern as shown in FIG. 1.

Figure 2:
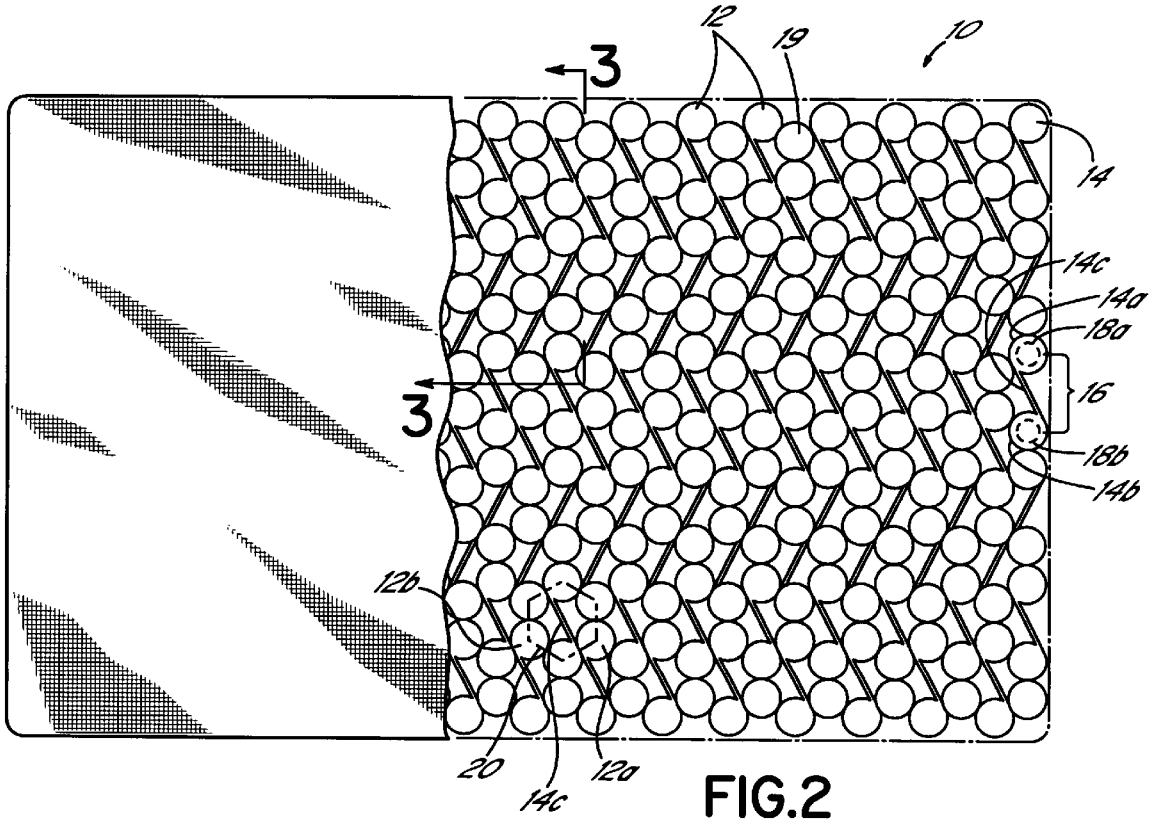
FIG. 2 is a top plan view partially broken away of a pocketed coil spring mattress according to one embodiment of this invention.
Figure 3:
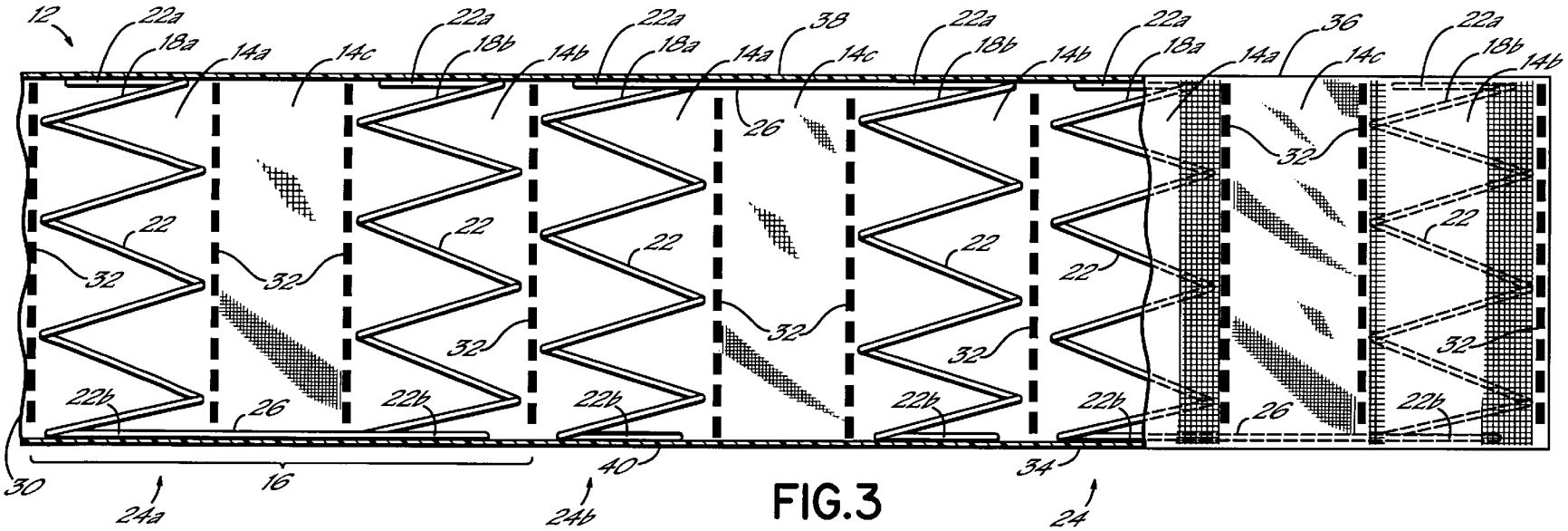
FIG. 3 is a cross-sectional view taken along line 3—3 of FIG. 2 of a row of pocketed coil springs partially broken away.

Referring to FIG. 2, a pocketed spring unit 10, such as a mattress or the like, according to one embodiment of this invention, is shown. The mattress 10 of FIG. 2, includes rows 12 of serially connected fabric pockets 14 as is well known in the industry. However, each grouping 16 of three adjacent fabric pockets 14 includes two coil springs 18*a*, 18*b* encased by two spaced fabric pockets 14*a*, 14*b* with an empty fabric pocket 14*c* therebetween which does not enclose a coil spring 18 (FIG. 3). Further, the coil springs 18 in each row 12 of the mattress 10, as shown in FIG. 2, are offset with respect to the coil springs 18 in each adjacent row 12*a*. As such, each pair of adjacent coil springs 18 that border an empty pocket 14*c* form a hexagonal pattern or configuration 20 with coil springs 18 from the adjacent two rows 12*a*, 12*b*.

One advantage of the spring arrangement and placement of coil springs 18 in the pocketed fabric material, according to the embodiment of this invention shown in FIG. 2, is the reduction of the total amount of coil springs 18 and wire used to form the pocketed coil spring mattress 10 and the associated costs, labor and expenses while still maintaining the same performance characteristics as those of known pocketed coil spring mattresses 2 and the like. For example, the spring unit 2 with a pocketed coil spring arrangement according to the prior art, as shown in FIG. 1, includes 191 coils per square yard in an array of 14×15 coil springs in 1.099 square yards. In contrast, the pocketed coil spring mattress or spring unit 10 of this invention as shown in FIG. 2, requires 160 coils per square yard in a 10×16 arrangement of coils. Based on these coil spring requirements, this invention provides a reduction in the coil spring requirements on the order of 16% and the associated costs and labor savings.

Moreover, the performance characteristics of the spring unit, mattress 10 or the like, according to this invention, are maintained because of the coil spring arrangement according to one embodiment of this invention. For example, in FIG. 3 the row or string 12 of pocketed coil springs 18 is shown. Each coil spring 18 includes a number of turns 22 and spaced end turns, such as a top end turn 22*a* and a bottom end turn 22*b* of each coil spring 18. It should be readily understood that terms such as top, bottom and the like as used herein are for reference only and should not be considered as limitations on this invention or the scope of the following claims.

Each coil spring 18 is part of a spring set 24 which includes a first coil spring 18*a* and a second coil spring 18*b* that are joined together by a connecting wire 26. Specifically, in one embodiment, the connecting wire 26 joins corresponding end turns 22*a* or 22*b* of the coil springs 18*a*, 18*b* of each spring set 24. Each coil spring 18 is encased in a fabric pocket 14, as shown in FIG. 3. The fabric pocket 14 typically is formed between the folded plies of a fabric material 30. The pocket 14 is defined by spaced transverse seams or welds 32 and a longitudinal seam or weld 34 which joins the free ends 36 of the plies 28 of the folded fabric material 30.

Each coil spring 18 of each spring set 24 is encased or inserted into an individual fabric pocket 14 of this type. Specifically, in each grouping 16 of three adjacent serially connected fabric pockets 14*a*, 14*b*, 14*a*, one of the coil springs 18*a* from each spring set 24 is inserted into a first fabric pocket 14*a* and the other coil spring 18*b* is inserted into a second fabric pocket 14*b* with an empty third fabric pocket 18*c* positioned therebetween. The intermediate or third fabric pocket 18*c* does not have a coil spring and is left empty with the exception of the connecting wire 26 joining the coil springs 18*a*, 18*b* of each spring set 24. The connecting wire 26 spans the third fabric pocket 14*c* , 18*c* of each grouping 16. Due to the connecting wire 26 which spans the intermediate fabric pocket 14*c*, the support provided by the spring unit or mattress 10 according to this invention is maintained because the load applied to the connecting wire 26 in the proximity of the third fabric pocket 14*c* is distributed to the joined coil springs 18*a*, 18*b* of the associated spring set 24.

Figure 5:
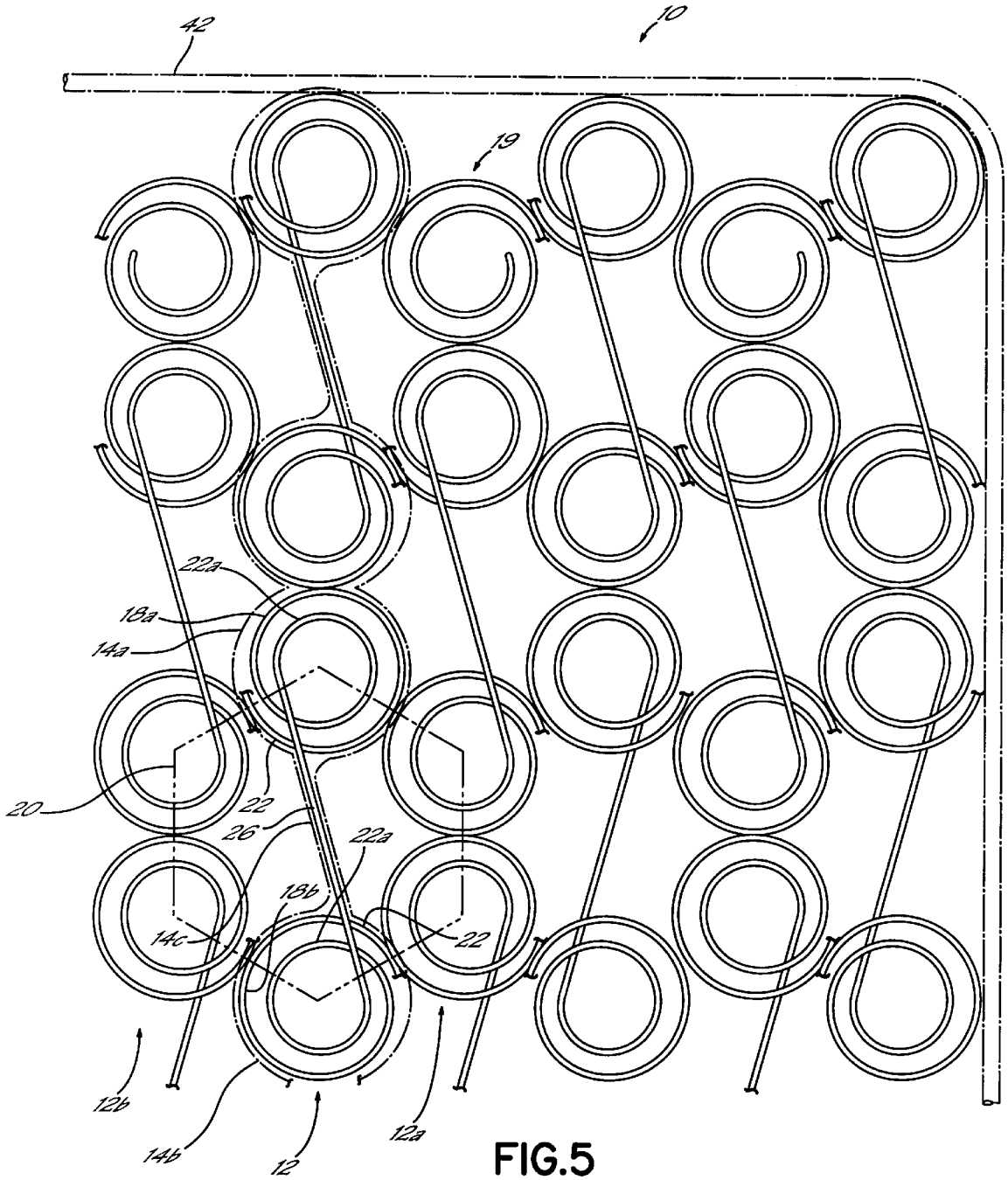
FIG. 5 is a top plan view of a portion of a mattress showing the springs sets arranged therein according to one embodiment of this invention.

In one embodiment of this invention, as shown in FIGS. 3 and 5, the connecting wire 26 of each spring set 24 is alternately positioned relative to a top face 38 and a bottom face 40 of the mattress, spring unit 10 or the like. Specifically, the connecting wire 26 of a first spring set 24*a* is positioned proximate the bottom face 40 of the mattress 10 and the connecting wire 26 of the next adjacent spring set 24*b* in the row 12 is positioned proximate the top face 38 of the mattress 10. Subsequent spring sets 24 in the row or string 12 of pocketed coil springs 18 are likewise alternately positioned thereby providing for consistent performance for the mattress, spring unit 10 or the like irrespective of its orientation. The connecting wire 26 is alternately located on top and bottom surfaces 38, 40 of the spring unit, mattress 10 or the like so that it can be conveniently flipped to-to-bottom and bottom-to-top without altering the performance characteristics.

In one embodiment of the mattress 10, a border 42 (FIG. 5) is used around the perimeter of the mattress 10. The border 42 may be a wire, foam or other material commonly used in the industry to contain or bind the end coil springs 18 of each row together and help maintain their positioning and spatial relationships. With a border 42, individual pocketed coil springs 19, as shown in FIG. 2, would likely not be required to maintain coil spring positions, but could be used as desired. Additionally, the individual rows 12 are glued, adhesively attached, bonded or mechanically joined to the adjacent row 12*a* as is well known in the art.

Figure 4A:
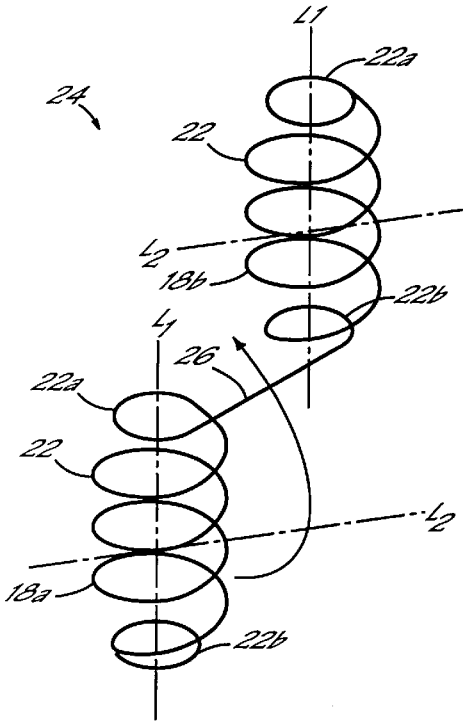
FIG. 4A is a diagrammatic representation of a manufacturing method for a spring set including two joined coil springs according to one embodiment of this invention.

Referring to FIGS. 4A through 4D, one embodiment of a method of making the spring set 24 according to this invention is shown. One known method for forming a coil spring utilizes a coiling machine to form a length of coil wire into the coil spring as disclosed in U.S. Pat. No. 4,439,977, for example. This invention utilizes the coiling machine to form an integral piece of wire into a first coil spring 18*a*, as shown in FIG. 4A, that has a top end turn 22*a*, a bottom end turn 22*b* and a number of intermediate turns 22*c*, and a connecting wire 26 which, in one embodiment, is generally linear, as shown in FIG. 4A, and projects from the top end turn 22*a* and extends to a bottom end turn 22*b* of a second coil spring 18*b*. The spring sets 24 are formed in this manner from a single integral piece of coil wire such that opposite end turns 22*a*, 22*b* of two coil springs 18*a*, 18*b* are joined integrally together by the connecting wire. Each coil spring 18 of the spring set 24 formed by the coiler, as shown in FIG. 4A, has a longitudinal axis $L_1$ which is generally parallel to and spaced from the longitudinal axis $L_1$ of the joined coil spring. Similarly, each coil spring 18 has a lateral axis $L_2$ which is parallel to and spaced from the lateral axis $L_2$ of the joined coil spring 18.

Figure 4B:
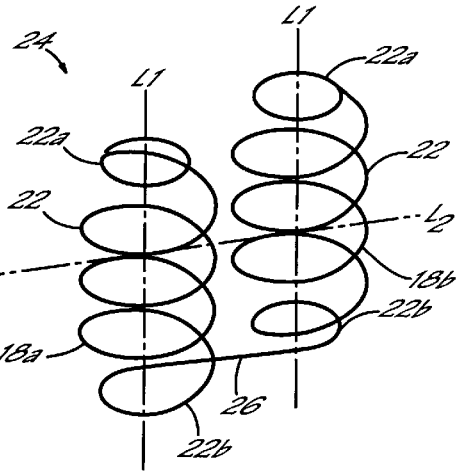
FIGS. 4B–4C are alternative configurations of spring sets resulting from the method of FIG. 4A.
Figure 4C:
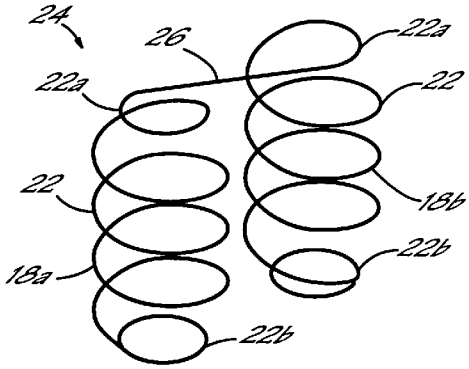

Subsequently, one of the coil springs 18, for example the first coil spring 18*a*, as shown in FIG. 4A, is manipulated in such a manner that the top end turn 22*a* becomes the bottom end turn 22*b*, as shown in FIG. 4B. Specifically, the first coil spring 18*a* is pivoted or rotated in the direction of arrow A approximately 180° about an axis defined generally by the connecting wire 26 relative to the second coil spring 18*b* into the configuration of the spring set 24 shown in FIG. 4B. As such, the spring set 24 as shown in FIG. 4B has the connecting wire 26 joining corresponding bottom end turns of the first and second coil springs 18*a*, 18*b*.

Figure 4D:
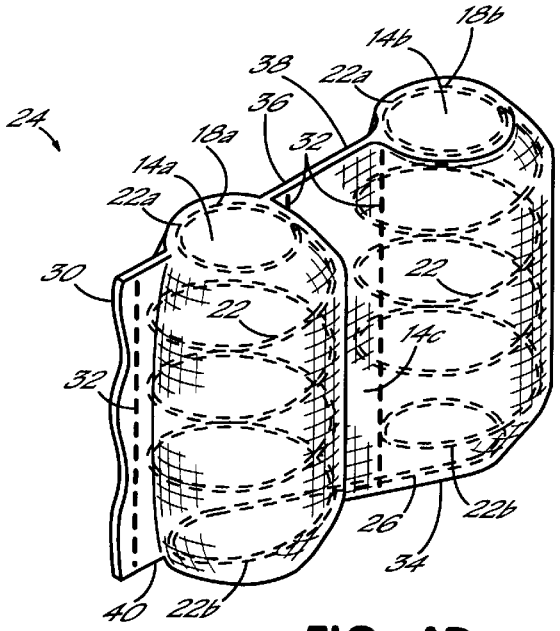
FIG. 4D is a perspective view of a portion of a string of pocketed coil springs according to one embodiment of this invention.

After the coil springs 18 are manipulated relative to one another, their longitudinal axes $L_1$ remain generally parallel and spaced with respect to each other; whereas, the lateral axes $L_2$ of the coil springs 18 become generally co-linear, as shown in FIG. 4B. After the spring set 24 is manipulated so that the connecting wire 26 joins corresponding end turns 22*a* or 22*b* of the coil springs 18, the spring set 24 may be inverted so that the connecting wire 26 is on the top or bottom of the spring set 24, as shown by comparison of FIGS. 4B and 4C. Subsequently, the spring set 24 is encased within fabric pocket material 30, as shown in FIG. 4D.

As a result of this invention, the numerous advantages of pocketed coil spring mattresses, spring units 10 and the like are achieved while reducing the total amount of wire needed without detrimentally impacting the performance characteristics thereof. Further, a method of producing such a spring unit 10 is obtained without complicated procedures, techniques, machine requirements and the like.

What is claimed is:

1. spring unit comprising:

a plurality of spring sets in which each spring set includes a first coil spring and a second coil spring joined together by a connecting wire; and a plurality of connected fabric pockets, each of the spring sets being encased in a grouping of adjacent fabric pockets such that the first coil spring is encased in a first fabric pocket and the second coil spring is encased in a second fabric pocket with a third fabric pocket between the first and second fabric pockets, the connecting wire spanning the third fabric pocket.

2. The spring unit of claim 1 wherein the third pocket does not have a coil spring therein.

3. The spring unit of claim 2 wherein the third pocket is empty.

4. The spring unit of claim 1 wherein the connecting wire joins together corresponding end turns of the first and second coil springs.

5. The spring unit of claim 4 wherein the connecting wire of a first spring set is proximate a top of the spring unit and the connecting wire of a second spring set adjacent to the first spring set is proximate a bottom of the spring unit.

6. The spring unit of claim 1 wherein each spring set is formed of a different and integral piece of wire.

7. The spring unit of claim 1 wherein the serially connected fabric pockets are formed from a length of fabric material folded about a longitudinal fold line into first and second fabric plies, each fabric pocket comprising a pair of spaced, generally parallel transverse seams joining the first and second fabric plies together and extending generally perpendicularly to the fold line and a longitudinal seam joining the first and second fabric plies together and extending generally perpendicularly to the transverse seams.

8. The spring unit of claim 1 wherein the first, second and third fabric pockets are all integrally and serially connected together.

9. A spring unit comprising:

a plurality of spring sets in which each spring set includes a first coil spring and a second coil spring joined together by a connecting wire which joins together corresponding end turns of the first and second coil springs, each spring set being formed of a different and integral piece of wire;

wherein the connecting wire of a first spring set is proximate a top of the spring unit and the connecting wire of a second spring set adjacent to the first spring set is proximate a bottom of the spring unit; and a plurality of connected fabric pockets, each of the spring sets being encased in a grouping of adjacent fabric pockets such that the first coil spring is encased in a first fabric pocket and the second coil spring is encased in a second fabric pocket with a third fabric pocket between the first and second fabric pockets such that the first, second and third fabric pockets are integrally and serially connected together with the connecting wire spanning the third fabric pocket which does not have a coil spring therein.

10. The spring unit of claim 9 wherein the serially connected fabric pockets are formed from a length of fabric material folded about a longitudinal fold line into first and second fabric plies, each fabric pocket comprising a pair of spaced, generally parallel transverse seams joining the first and second fabric plies together and extending generally perpendicularly to the fold line and a longitudinal seam joining the first and second fabric plies together and extending generally perpendicularly to the transverse seams.

11. An article of furniture having at least one spring unit comprising:

a plurality of spring sets in which each spring set includes a first coil spring and a second coil spring joined together by a connecting wire; and a plurality of connected fabric pockets, each of the spring sets being encased in a grouping of adjacent fabric pockets such that the first coil spring is encased in a first fabric pocket and the second coil spring is encased in a second fabric pocket with a third fabric pocket between the first and second fabric pockets, the connecting wire spanning the third fabric pocket.

12. A mattress comprising:

a plurality of rows of spring sets in which each spring set includes a first coil spring and a second coil spring joined together by a connecting wire; and a plurality of connected fabric pockets, each of the spring sets being encased in a grouping of adjacent fabric pockets such that the first coil spring is encased in a first fabric pocket and the second coil spring is encased in a second fabric pocket with a third fabric pocket between the first and second fabric pockets, the connecting wire spanning the third fabric pocket.

13. The mattress of claim 12 wherein the spring sets in a first row of pocketed spring sets is offset relative to the spring sets in an adjacent row of pocketed spring sets.

14. The mattress of claim 12 wherein the coil springs of each spring set form a hexagonal configuration with adjacent coil springs from adjacent rows of pocketed spring sets.

15. The mattress of claim 12 wherein the third pocket does not have a coil spring therein.

16. The mattress of claim 15 wherein the third pocket is empty.

17. The mattress of claim 12 wherein the connecting wire joins together corresponding end turns of the first and second coil springs.

18. The mattress of claim 17 wherein the connecting wire of a first spring set is proximate a top face of the mattress and the connecting wire of a second spring set adjacent to the first spring set and in the same row is proximate a bottom face of the mattress.

19. The mattress of claim 12 wherein each spring set is formed of a different and integral piece of wire.

20. The mattress of claim 12 wherein the serially connected fabric pockets are formed from a length of fabric material folded about a longitudinal fold line into first and second fabric plies, each fabric pocket comprising a pair of spaced, generally parallel transverse seams joining the first and second fabric plies together and extending generally perpendicularly to the fold line and a longitudinal seam joining the first and second fabric plies together and extending generally perpendicularly to the transverse seams.

21. The mattress of claim 12 wherein the first, second and third fabric pockets are all integrally and serially connected together.

22. A method of making a spring unit comprising:

forming a plurality of spring sets each with a first coil spring having spaced end turns joined by a connecting wire to a second coil spring having spaced end turns such that the connecting wire joins opposite end turns of the first and second coil springs;

manipulating the first coil spring relative to the second coil spring of each spring set so that the connecting wire joins corresponding end turns of the first and second coil springs;

forming a plurality of fabric pockets;

inserting the first and second coil springs of each spring set into selected fabric pockets; and arranging the pocketed spring sets into a spring unit.

23. A method of making a spring unit comprising:

forming a plurality of spring sets each with a first coil spring having a first longitudinal axis and spaced end turns, the first coil spring being joined by a connecting wire to a second coil spring having a second longitudinal axis and spaced end turns such that the connecting wire joins opposite end turns of the first and second coil springs, wherein each of the spring sets are formed with the first and second longitudinal axes being spaced from one another:

manipulating the first coil spring relative to the second coil spring of each spring set so that the connecting wire joins corresponding end turns of the first and second coil springs and the first and second longitudinal axes remain spaced from one another;

wherein the manipulating further comprises pivoting one of the first and second coil springs approximately 180° relative to the other coil spring;

forming a plurality of fabric pockets;

inserting the first and second coil springs of each spring set into selected fabric pockets; and arranging the pocketed spring sets into a spring unit.

24. The method of claim 23 wherein the pivoting is about an axis defined generally by the connecting wire.

25. A method of making a spring unit comprising:

forming a plurality of spring sets each with a first coil spring having spaced end turns joined by a connecting wire to a second coil spring having spaced end turns such that the connecting wire joins opposite end turns of the first and second coil springs;

manipulating the first coil spring relative to the second coil spring of each spring set so that the connecting wire joins corresponding end turns of the first and second coil springs;

forming a grouping of first, second and third adjacent and serially connected fabric pockets with the third fabric pocket being between the first and second fabric pockets;

inserting the first coil spring of one spring set into the first fabric pocket;

inserting the second coil spring of the one spring set into the second fabric pocket so that the connecting wire of the one spring set spans the third fabric pocket;

arranging the pocketed spring sets into a spring unit.

26. The method of claim 25 further comprising:

orienting the connecting wire of the one spring set proximate a top of the spring unit; and orienting the connecting wire of an adjacent spring set proximate a bottom of the spring unit.

27. A method of making a spring unit comprising:

forming a plurality of spring sets each with a first coil spring joined by a connecting wire to a second coil spring;

forming a plurality of fabric pockets including a grouping of first, second and third adjacent and serially connected fabric pockets with the third fabric pocket being between the first and second fabric pockets;

inserting the first coil spring of one spring set into the first fabric pocket;

inserting the second coil spring of the one spring set into the second fabric pocket so that the connecting wire of the one spring set spans the third fabric pocket; and arranging the pocketed spring sets into a spring unit.

28. The method of claim 27 wherein the connecting wire of each spring unit joins corresponding end turns of the first and second coil springs.

29. The method of claim 28 further comprising:

orienting the connecting wire of the one spring set proximate a top of the spring unit; and orienting the connecting wire of an adjacent spring set proximate a bottom of the spring unit.

30. The method of claim 27 wherein the pocketed spring sets are arranged into a plurality of similarly oriented rows of pocketed spring sets.

31. The method of claim 30 further comprising:

arranging the spring sets in a first row of pocketed spring sets to be offset relative to the pocketed spring sets in an adjacent row.

32. The method of claim 30 wherein the pocketed coil springs of each spring set are arranged to form a hexagonal configuration with adjacent pocketed coil springs from adjacent rows of pocketed spring sets.

33. A method of making a spring unit comprising:

forming a plurality of spring sets each with a first coil spring having spaced end turns joined by a connecting wire to a second coil spring having spaced end turns such that the connecting wire joins opposite end turns of the first and second coil springs;

manipulating the first coil spring relative to the second coil spring of each spring set so that the connecting wire joins corresponding end turns of the first and second coil springs;

forming a plurality of fabric pockets;

inserting the first and second coil springs of each spring set into individual respective first and second fabric pockets; and arranging the pocketed spring sets into a spring unit.

* * * * *